US005597159A

United States Patent [19]

Haygood et al.

[11] Patent Number: 5,597,159

[45] Date of Patent: Jan. 28, 1997

[54] BATTING PRACTICE DEVICE

[75] Inventors: James G. Haygood, 1805 E. Okaloosa Ave., Tampa, Fla. 33604; Jeffrey T. Calloway, Tampa, Fla.

[73] Assignee: James G. Haygood, Tampa, Fla.

[21] Appl. No.: 558,095

[22] Filed: Nov. 15, 1995

[51] Int. Cl.[6] ..... A63B 69/00

[52] U.S. Cl. ..... 473/424; 473/424

[58] Field of Search ..... 273/26 E, 58 C, 273/414

[56] References Cited

U.S. PATENT DOCUMENTS

| | | | |
|---|---|---|---|
| 3,637,209 | 1/1972 | Raut | 273/26 E |
| 3,907,287 | 9/1975 | Fox et al. | 273/26 E |
| 3,934,873 | 1/1976 | Griffin | 273/26 E |
| 5,165,682 | 11/1992 | McGuckin et al. | 273/26 E |
| 5,238,241 | 8/1993 | Christensen | 273/26 E |

*Primary Examiner*—William H. Grieb
*Attorney, Agent, or Firm*—American Innovations, Inc.; Dorothy S. Morse

[57] ABSTRACT

A batting practice device which has a partially hollowed-out practice ball suspended by a knotted rope, or a line having a flared-out end, from a handle. The batting practice device is used to swing a practice ball with a removable cap in front of batters to help them develop the eye-to-hand coordination needed to hit balls pitched to them during a game. The batting practice device has a combination of universal joints, elastic material, and springs located between the handle and the practice ball to help absorb most of the energy transferred to the practice ball after it has been hit by a bat. Applications may include, but are not limited to, baseball, softball, wiffle ball and cricket. It is contemplated for the batting practice device to be used by inexperienced players, as well as college and professional players.

20 Claims, 3 Drawing Sheets

BATTING PRACTICE DEVICE

BACKGROUND—FIELD OF INVENTION

This invention relates to batting practice devices, specifically to a batting practice device having a partially hollowed-out ball with a removable cap suspended by a rope or line with a flared-out end from a knotted handle, and a combination of universal joints, elastic material, and springs between the ball and the handle to help absorb the energy transferred to the practice ball after it has been hit by a bat. Applications may include, but are not limited to, baseball, softball, wiffle ball and cricket. It is also contemplated for the batting practice device to be used by inexperienced players, as well as college and professional players.

BACKGROUND—DESCRIPTION OF PRIOR ART

People who play softball, baseball, wiffle ball and cricket must develop good eye-to-hand coordination to be able to play their sport well. Team practice is limited and players must find other ways to obtain batting practice time.

Machines are available for pitching balls to a batter, but they are expensive to own and lease.

Batting practice involving the hitting of stationary balls from a support and batting practice commonly called "soft-toss", in which a batter or another person tosses a ball up into the air for the batter to hit it as it falls back to the ground, fail to help batters develop the eye-to-hand coordination needed to hit balls moving toward them. Batting practice involving a batting stick and a wiffle ball attached to one end of a cord, whether the other end of the cord is connected to a pole which is stuck into the ground and the wiffle ball is manipulated by the batter hitting it directly with a bat as it extends from the cord, or the wiffle ball is tossed by hand close enough to a batter so that the batter may attempt to hit it fails to simulate a pitched ball moving toward the batter.

Should a batter seek help from friends or other players for batting practice, disadvantages to this type of batting practice include the fact that the person pitching is usually not a skilled pitcher, therefore the benefit received from such practice is variable. Also, the actual amount of time spent batting varies with the amount of time spent running for, and looking for, the balls after they are hit. A further disadvantage of this type of batting practice is that a large area is usually required so that a hit ball does not endanger neighbors, or break a window. It is not known for a batting practice device to have been patented which has a practice ball suspended by a rope or cable from a handle so that the practice ball does not have to be chased after being hit, which has a combination of universal joints, elastic material, and springs between the handle and the practice ball to help absorb the energy transferred to the ball after it has been hit by a bat, and which may be manually manipulated to simulate pitched balls of varying speeds up to approximately 100 miles per hour.

SUMMARY OF INVENTION—OBJECTS AND ADVANTAGES

It is the primary object of this invention to provide a batting practice device which will simulate the movement of a pitched ball toward a batter. It is a secondary object of this invention to provide a batting practice device which does not require a person to chase after a ball which has been hit so that the batting practice time is more productive. A further object of this invention is to provide a batting practice device which will absorb most of the energy transferred to a practice ball after it has been hit by a bat. It is also an object of this invention to provide a batting practice device with replaceable components. It is also an object of this invention to provide a batting practice device which is manually controlled and able to present simulated pitches of varying speeds to the batter. A further object of this invention is to provide a batting practice device which will not twist in the user's arms if spin is placed on the practice ball as it is hit by a bat. It is also an object of this invention to provide a batting practice device that is inexpensive enough to become widely used by inexperienced players, as well as college and professional players.

As described herein, properly manufactured and used, the present invention would provide a batting practice device that would simulate the movement of a pitched ball. Since the practice ball is attached to a knotted rope or line with a flared-out end, batting practice would not be interrupted by the need for someone to chase the balls which had been hit. The batting practice device has universal joints, a spring, and elastic material between the practice ball and the handle to help absorb most of the energy transferred to the practice ball after it has been hit by a bat. The universal joints will also prevent the batting practice device from twisting in a user's hands if spin is placed on the practice ball as it is hit. Also, when the embodiment of the invention having a rope to support the practice ball is used, should the rope break, it can be cut off and repeatedly reknotted for further use, until it is too short for safe use. The practice ball may also be replaced when worn, or when a different sized ball is needed for batting practice. The present invention would allow the user to control the direction, height and speed of the practice ball as it approaches the batter. The practice ball could be extended toward the batter to simulate an inside pitch. The practice ball could also be made to drop like a slider. In addition, a knuckle ball could be simulated by shaking the handle as the practice ball approaches the batter. A longer line with a flared-out end or knotted rope would allow the batting practice device to better simulate high speed fast balls, a benefit for college and professional players. A protective screen, or similar device, may be used with present invention to protect the person swinging the batting practice device from the rare possibility of erratic movement by the practice ball should the batter hit the practice ball with the end of a bat. As may be determined by the description herein, and elsewhere in this patent application, there are many advantages to the present batting practice invention, the greatest advantage being its ability to accurately and predictably simulate varying types of balls thrown by a pitcher.

The description herein provides preferred embodiments of the present invention but should not be construed as limiting the scope of the batting practice device invention. For example, variations in the size of ball used, the material from which the knotted rope or line with a flared-out end is made, the type of elastic material used, the size and shape of the handle, the type of spring used, the number of universal joints used, and the means of attaching the knotted rope or line with a flared-out end to the handle and ball, other than those shown and described herein, can be incorporated into the present invention. Thus the scope of the present invention should be determined by the appended claims and their legal equivalents, rather than the examples given.

DETAILED DESCRIPTION OF PREFERRED EMBODIMENTS

Figure 1:
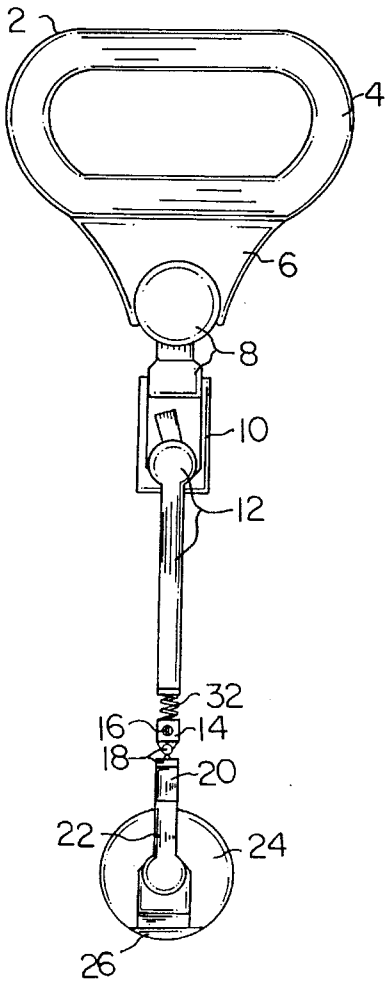
FIG. 1 is a front view of a first embodiment of the invention having a knotted rope connected to the handle and a line with a flared-out end connected to the ball.

FIG. 1 shows one preferred embodiment of a batting practice device invention 2 having a handle 4, a hollowed-out practice ball 24, and a rope 12 therebetween. Handle 4 has a ball joint support 6 depending therefrom within which a universal ball joint 8 freely rotates. Universal ball joint 8 has an externally threaded portion depending therefrom FIG. 1 also shows one end of rope 12 being knotted. This knotted end of rope 12 is positioned within a hollowed-out clamp 10 which has openings on opposed ends. The length of rope 12 extends through one of the openings in clamp 10, while the opposed opening has internal threads for attachment to the externally threaded portion depending from universal ball joint 8. The internally threaded opening in clamp 10 is large enough for the knotted end of rope 12 to pass through so that rope 12 may be replaced, or its length adjusted. When the externally threaded portion of universal ball joint 8 is connected to the internally threaded portion of clamp 10, the knotted end of rope 12 becomes enclosed within clamp 10. The length of rope 12 extends away from handle 4 and is connected to one end of a spring 32. A removable bracket 14, connected to the other end to spring 32 by a screw 16, is also connected to a combined universal ball joint and bracket member 18. It is contemplated for spring 32 to be placed anywhere between handle 4 and practice ball 24. Clamp 10 and universal ball joint 8 helps to prevent batting practice device invention 2 from twisting when spin is placed on practice ball 24 as it is hit by a bat.

FIG. 1 also shows practice ball 24 having a partially hollowed-out interior, one end of which is enlarged relative to the other end, which extends through the surface of practice ball 24 on opposed sides. A removable cap 26 covers the larger opening in practice ball 24. In the preferred embodiment, removable cap 26 is attached to practice ball 24 by threaded means. FIG. 1 also shows practice ball 24 attached to a line 22 which has a straight end and a flared-out end. In the preferred embodiment, line 22 is made of a strong material. The straight end of line 22 extends through the narrow end of the hollowed-out interior of practice ball 24 and the flared-out end of cable 22 remains enclosed within the practice ball 24 by removable cap 26. The straight end of line 22 is attached to one end of an elastic material 20. The opposed end of elastic material 20 is connected to combined universal ball joint and bracket member 18.

Batting practice device invention 2 may also have a safety strap (not shown) attached to handle 4 which would be used to attach batting practice device invention 2 to a user's arm. The safety strap (not shown) may be made of elastic, or other material which would securely connect batting practice device invention 2 to the user's arm. Then, with the safety strap (not shown) properly in place around a user's arm, batting practice device invention 2 will not be capable of becoming separated from the user during use should the user's hands become sweaty and cause the user to lose his or her grip on handle 4. Safety strap (not shown) may also be used to hang batting practice device invention 2 from a nail or hook during storage.

Figure 3:
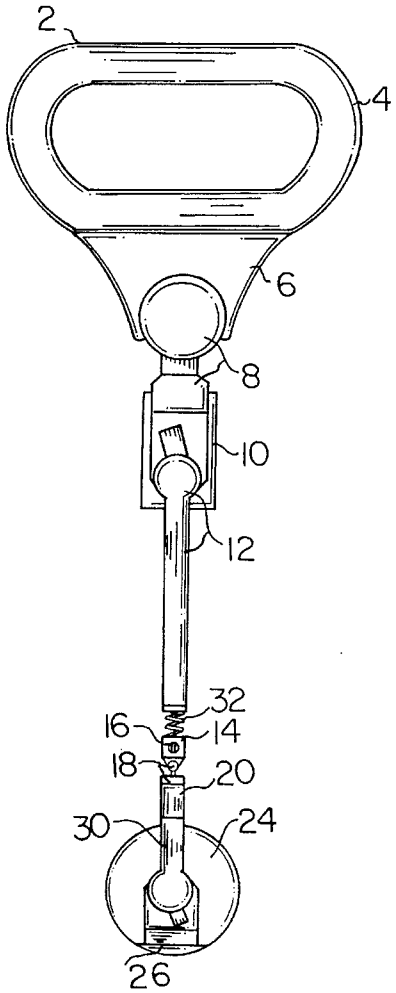
FIG. 3 is a front view of the third embodiment of the invention showing the attachment of both the handle and the ball connected by ropes.
Figure 2:
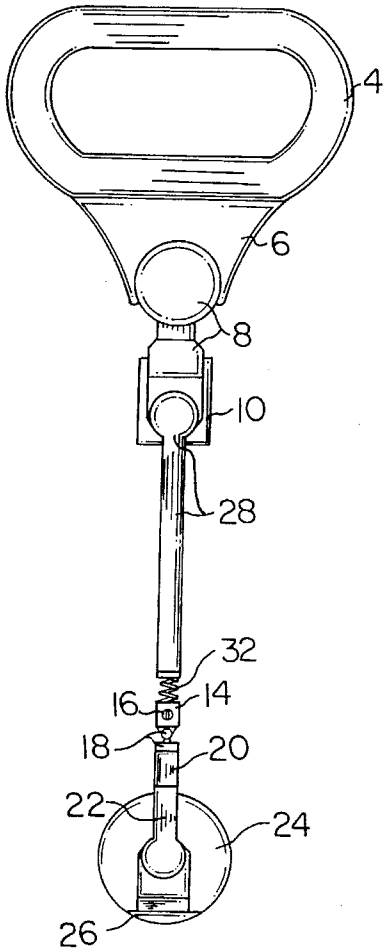
FIG. 2 is a front view of a second embodiment of the invention having both the handle and the ball connected by lines with flared-out ends.
Figure 4:
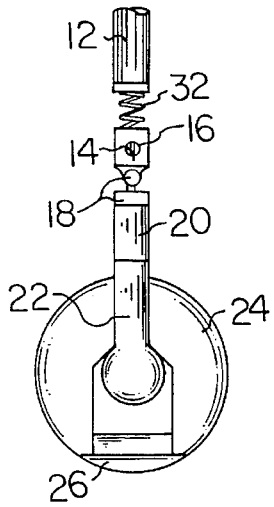
FIG. 4 is an enlarged view of the first embodiment of the invention showing a spring, universal joint, elastic material and a line with a flared-out end connected to the ball.
Figure 5:
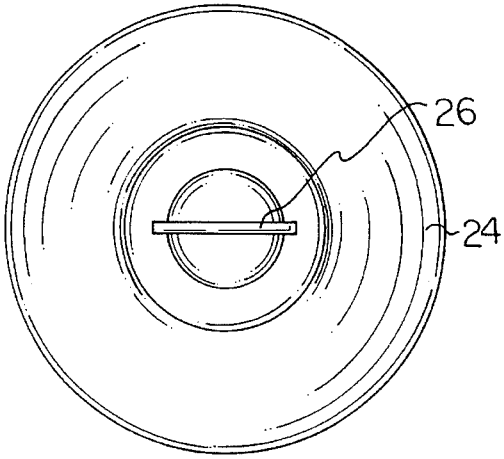
FIG. 5 is a bottom view of the invention showing the ball and a cap.
Figure 6:
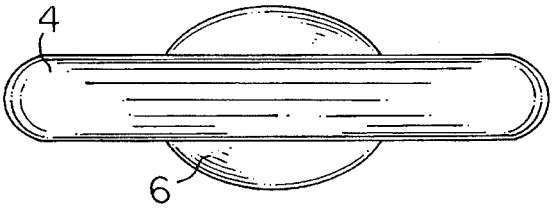
FIG. 6 is a top view of the handle on the invention.
Figure 7:
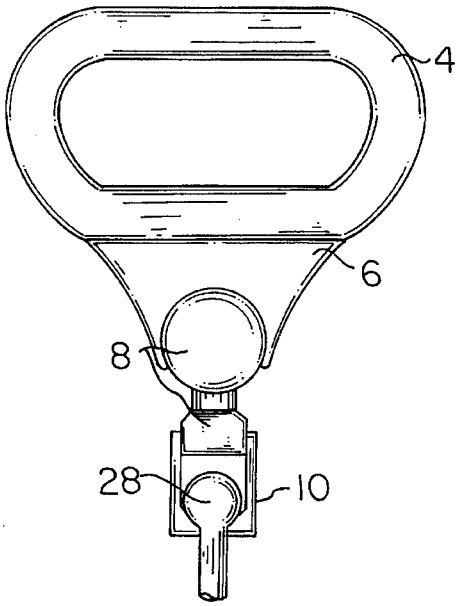
FIG. 7 is a cutout view of the handle on the second embodiment of the invention showing the handle attachment to the line with a flared-out end.
Figure 8:
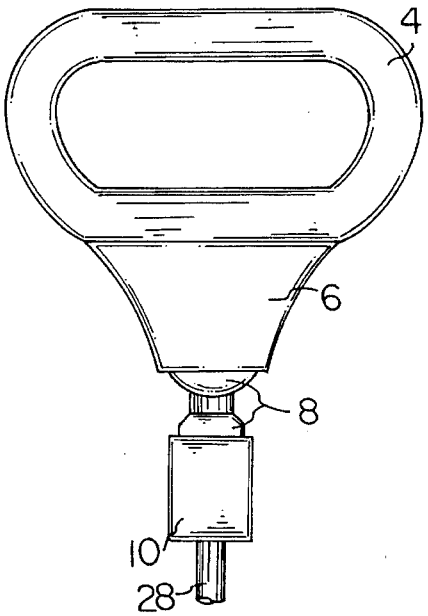
FIG. 8 is a perspective view of the handle on the second embodiment of the invention.
Figure 9:
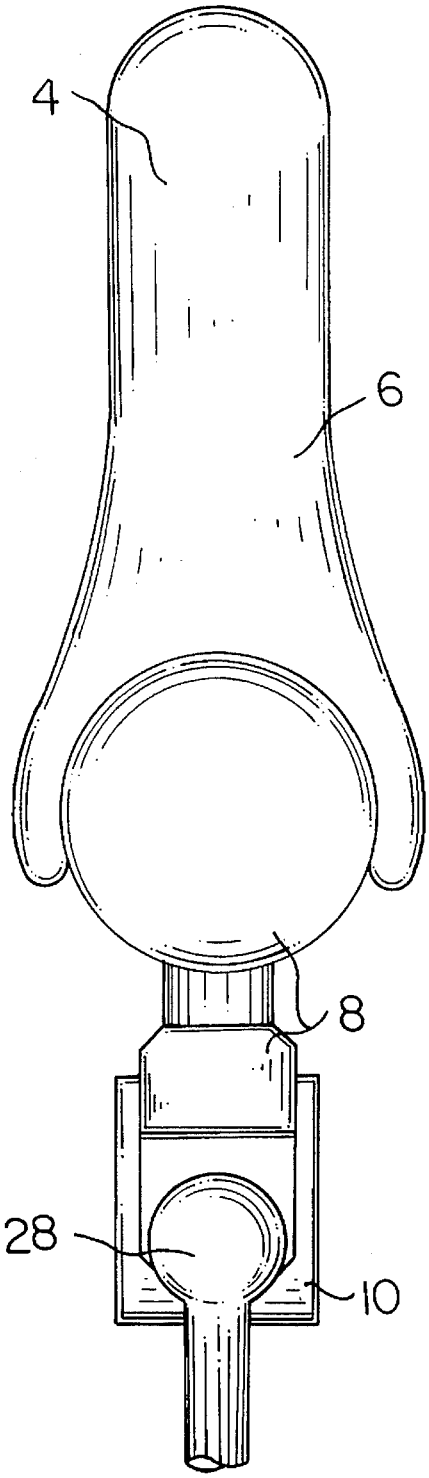
FIG. 9 is a side view of the handle on the second embodiment of the invention.

FIG. 2 shows a second embodiment of batting practice device invention 2 with rope 12 being replaced by a line 28. Line 28 has a flared-out end which is positioned within clamp 10. FIG. 3 shows a third embodiment of batting practice device invention 2 with line 22 being replaced by a small knotted rope 30, the knotted end of which is positioned within hollowed-out practice ball 24 and enclosed by removable cap 26. FIGS. 4, 5 and 6 respectively show enlarged details of practice ball 24, removable cap 26 and handle 4. FIG. 6 shows handle 4, while FIGS. 7, 8, and 9 show enlarged details of the connection of handle 4 and line 28 to clamp 10.

Although the material from which practice ball 24 is made is not critical, it is contemplated in the preferred embodiment for practice ball 24 to be made of a strong, but resilient, rubber or plastic. Practice balls 24 may also have outer coverings (not shown) for simulation of different types of balls. Also, the length of rope 12 or line 28 is not critical to the present invention. However, in the preferred embodiment, the lengths of rope 12 and line 28 are contemplated to be with in a range of lengths varying between four feet and twenty feet. The longer lengths of rope 12 and line 28, and thinner lines 28, allow for simulations of a high speed pitch. The compositions of line 28 and rope 12 are also not critical to the present invention. In the preferred embodiment rope 12 may be made of a woven, or braided material, or be in the form of a chain. The material from which handle 4 is made is also not critical. However, in the preferred embodiment, handle 4 is made of a strong plastic or metal.

During use, batting practice device invention 2 would be swung by a user (not shown) who would stand at a predetermined distance from a batter (not shown). It is contemplated for the user to hold handle 4 with one hand, although two hands could be used. The user, standing partially behind a protective screen (not shown), swings batting practice device invention 2 toward the batter to simulate a pitched ball. After the batter hits practice ball 24 with a bat (not shown), the user maintains a grip on handle 4, while universal joint 8, combined universal ball joint and bracket member 18, spring 32 and elastic material 20 located between practice ball 24 and handle 4 help to absorb and divert away from the user most of the energy transferred to practice ball 24 by the swinging motion of the bat (not shown). When a different sized practice ball 24 is needed for batting practice, the user or the batter may remove the currently attached practice ball 24 from batting practice device invention 2 by unscrewing both removable cap 26 and screw 16, gripping the flared end of line 22, or the knotted end of small knotted rope 30, and pulling line 22, or small knotted rope 30, away from practice ball 24. A different sized practice ball 24 may then be reconnected to batting practice device invention 2 by inserting the straight end of line 22, or the straight end of small knotted rope 30, into the new practice ball 24, reconnecting the straight end of line 22, or the straight end of small knotted rope 30, into removable bracket 14, and rescrewing removable cap 26 and screw 16 into their usable positions.

What is claimed is:

1. A batting practice device for use by a first person to provide batting practice to a second person with a bat, said batting practice device comprising a handle having a ball joint support attached thereto for connection to the ball of a universal joint; a practice ball having a removable cap attached thereto so that said practice ball can be quickly removed from the remainder of said batting practice device for replacement; at least two universal joints connected between said handle and said practice ball, each of said universal joints comprising a ball and a ball joint support; a plurality of flexible members connected between said handle and said practice ball; a plurality of energy absorbing members connected between said handle and said practice ball; and connection means to connect said universal joints, said flexible members and said energy absorbing members between said handle and said practice ball so that most of the energy transferred to said practice ball when said practice ball is hit by said bat is absorbed and diverted away from said first person and so that said universal joints work together to diminish tangling of said first flexible member.

2. A batting practice device for use by a first person to provide batting practice to a second person with a bat, said batting practice device comprising a handle; a first flexible member; a first universal joint connected between said handle and said first flexible member, a first connection means to connect said first universal joint between said handle and said first flexible member; a second universal joint connected to said first flexible member, a second connection means to connect said second universal joint to said first flexible member; a practice ball; a second flexible member connected between said practice ball and said second universal joint; a third connection means to connect said second flexible member to said practice ball; and energy absorbing means connected to said batting practice device between said handle and said practice ball so that said energy absorbing means, said second flexible member, said first universal joint, and said second universal joint may absorb and divert away from said first person most of the energy transferred to said practice ball when said practice ball is hit by said bat, and so that said first universal joint and said second universal joint work together to diminish tangling of said first flexible member.

3. The batting practice device of claim 2 wherein said first flexible member comprises a quantity of rope having a knotted end, said knotted end connected to said handle.

4. The batting practice device of claim 2 wherein said first flexible member comprises a quantity of line having a flared-out end, said flared-out end connected to said handle.

5. The batting practice device of claim 2 wherein said second flexible member comprises a quantity of rope having a knotted end and a quantity of elastic material, said knotted end connected to said practice ball.

6. The batting practice device of claim 2 wherein said second flexible member comprises a quantity of line having a flared-out end and a quantity of elastic material, said flared-out end connected to said practice ball.

7. The batting practice device of claim 2 further comprising a removable cap attached to said practice ball for ease in removing and replacing said practice ball from said second flexible member.

8. The batting practice device of claim 2 wherein said first flexible member has an enlarged end portion and wherein said first connection means comprises a threaded member depending from said first universal joint and a connecting member having mating threads for connection with said threaded member, said connecting member having a hollow interior for securing said enlarged end portion of said first flexible member.

9. The batting practice device of claim 2 wherein said second connection means comprises a removable bracket and means to secure said removable bracket in its usable position.

10. The batting practice device of claim 2 wherein said energy absorbing means comprises spring means.

11. The batting practice device of claim 2 wherein said practice ball has a hollow interior and a removable cap, said second flexible member has a enlarged end, and wherein said third connection means comprises secure attachment of said enlarged end within said hollow interior and sealing of said enlarged end within said hollow interior by said removable cap.

12. The batting practice device of claim 2 further comprising a safety strap connected to said handle for secure connection of said batting practice device to an arm of said user so that said batting practice device may not become separated from said user during use.

13. A batting practice device for use by a first person to provide batting practice to a second person with a bat said batting practice device comprising a handle having a universal joint supporting member depending therefrom; a first flexible member having two opposed ends; a first universal joint rotatably connected to said universal joint supporting member, said first universal joint having a threaded member depending therefrom; attachment means having mating threads connected to said threaded member, said attachment means also connected to one of said opposed ends of said first flexible member; a removable bracket connected to the other of said opposed ends of said first flexible member; a second universal joint connected to said removable bracket; an elastic member connected to said second universal joint; a practice ball; a second flexible member connected between said elastic member and said practice ball; and energy absorbing means connected between said handle and said practice ball so that said energy absorbing means, said second flexible member, said first universal joint, and said second universal joint may absorb and direct away from said first person most of the energy transferred to said practice ball when said practice ball is hit by said bat and so that said first universal joint and said second universal joint work together to diminish tangling of said first flexible member.

14. The batting practice device of claim 13 wherein said first flexible member comprises a quantity of rope having a knotted end, said knotted end connected to said handle.

15. The batting practice device of claim 13 wherein said first flexible member comprises a quantity of line having a flared-out end, said flared-out end connected to said handle.

16. The batting practice device of claim 13 further comprising a quantity of rope having a knotted end connected between said quantity of elastic material and said practice ball, said knotted end being connected to said practice ball.

17. The batting practice device of claim 13 further comprising a quantity of line having a flared-out end connected between said quantity of elastic material and said practice ball, said flared-out end connected to said practice ball.

18. The batting practice device of claim 13 wherein said practice ball has a surface and a hollowed-out interior opening through said surface, and further comprising a removable cap attached to said practice ball to seal said opening for ease in removing and replacing said practice ball from said second flexible member.

19. The batting practice device of claim 13 wherein said energy absorbing means comprises spring means connected between said removable bracket and said first flexible member.

20. The batting practice device of claim 13 wherein said attachment means comprises a clamp having a hollow interior, said first flexible member has an enlarged portion, and said enlarged portion remains positioned within said hollow interior during use.

* * * * *